US006834490B2

(12) United States Patent
Stahlecker

(10) Patent No.: US 6,834,490 B2
(45) Date of Patent: Dec. 28, 2004

(54) ARRANGEMENT FOR OPEN-END ROTOR SPINNING

(75) Inventor: Gerd Stahlecker, Eislingen/Filz (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 10/783,089

(22) Filed: Feb. 23, 2004

(65) Prior Publication Data

US 2004/0221568 A1 Nov. 11, 2004

Related U.S. Application Data

(63) Continuation of application No. PCT/EP02/08509, filed on Jul. 31, 2002.

(30) Foreign Application Priority Data

Aug. 21, 2001 (DE) ..... 101 41 967

(51) Int. Cl.[7] ..... D01H 4/08
(52) U.S. Cl. ..... 57/407; 57/408
(58) Field of Search ..... 57/404–417

(56) References Cited

U.S. PATENT DOCUMENTS 3,685,272 A 8/1972 Greenwood et al.
3,884,027 A 5/1975 Schumann et al.
4,703,616 A * 11/1987 Feuchter et al. ..... 57/105
4,899,528 A * 2/1990 Fahmuller et al. ..... 57/92
5,433,068 A * 7/1995 Stahlecker ..... 57/407
5,592,808 A * 1/1997 Brunner et al. ..... 57/408
2004/0000133 A1 * 1/2004 Wassenhoven et al. ..... 57/406

FOREIGN PATENT DOCUMENTS

| | | |
|---|---|---|
| DE | 21 61 619 | 8/1973 |
| DE | 24 51 551 | 5/1976 |
| DE | 196 50 597 | 6/1998 |
| GB | 1 461 029 | 1/1977 |

* cited by examiner

*Primary Examiner*—John J. Calvert
*Assistant Examiner*—Shaun R Hurley
(74) *Attorney, Agent, or Firm*—Crowell & Moring LLP

(57) ABSTRACT

In an arrangement for application in open-end rotor spinning, an opening roller is housed in a swivel housing. The swivel housing can, together with the assembled opening roller, be removed from the arrangement for open-end rotor spinning when the machine is in operation. The opening roller, due to its mass, continues to rotate after it has been separated from the tangential belt which drives it. A locking device is provided which prevents the removal of the swivel housing when the opening roller is rotating. This results in the opening roller being at a standstill when the swivel housing is removed. The risk of injury caused by a still rotating opening roller is eliminated.

20 Claims, 6 Drawing Sheets

ARRANGEMENT FOR OPEN-END ROTOR SPINNING

BACKGROUND AND SUMMARY OF THE INVENTION

This application is a continuation of International Patent Application No. PCT/EP02/08509 filed on Jul. 31, 2002, designating the United States of American, the entire disclosure of which is incorporated herein by reference. Priority is claimed based on Federal Republic of Germany Patent Application No. 101 41 967.8 filed Aug. 21, 2001.

The present invention relates to an arrangement for application in open-end rotor spinning comprising an opening roller which is driven by a tangential belt and which can be brought to a standstill by means of a brake, said opening roller being taken up in a swivel housing, which is supported by a holding device and which can be removed therefrom together with the assembled opening roller while the tangential belt is still circulating.

An arrangement of this type is known from U.S. Pat. No. 5,433,068 and from the practical embodiment of the arrangement described therein, which is delivered worldwide in large-scale production.

In the known arrangement, the swivel housing can be disassembled together with the assembled opening roller while the tangential belt is circulating. During disassembly, the contact between the opening roller and the tangential belt is interrupted. Due to its mass, however, the opening roller continues to rotate for some time thereafter. An operator coming into contact with the still rotating opening roller either before or after the disassembly is at risk of injury, if the opening roller has not been stopped beforehand by means of activating the brake.

It is an object of the present invention to permit safer disassembly of the swivel housing in a simple way.

This object has been achieved in accordance with the present invention in that a locking device is provided which prevents the swivel housing from being removed while the opening roller is still rotating.

With the embodiment according to the present invention, it is now possible to remove the swivel housing for maintenance purposes from the operator's side without the risk of injury from a still rotating opening roller.

The locking device can take various forms and can function either electrically or mechanically.

In an advantageous embodiment, the locking device is coupled with the brake in such a way that the swivel housing is only released when the brake has been activated. It can thus be established in a simple way that the swivel housing can only then be removed when the brake has already been activated. The risk of injury from the opening roller to the operator due to inattention or carelessness is therefore eliminated.

In an advantageous embodiment, the locking device is designed as a movable lever, which can be brought into a position which prevents the swivel housing being removed. It is hereby practical when the lever is arranged on the swivel housing and comprises a stopping face which can be disposed on a countersurface in the arrangement for open-end rotor spinning. The risk of injury can thus be eliminated in a particularly simple and effective way.

In a further advantageous embodiment, the locking device and the brake are activated by a joint activating element. Protection from injury can thus be obtained by means of a very simple design, as the already present activating lever for the brake can be used for a further function.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

The arrangement for open-end rotor spinning comprises as important spinning elements a spinning rotor 1, a feed roller 2 and an opening roller 3.

Figure 1:
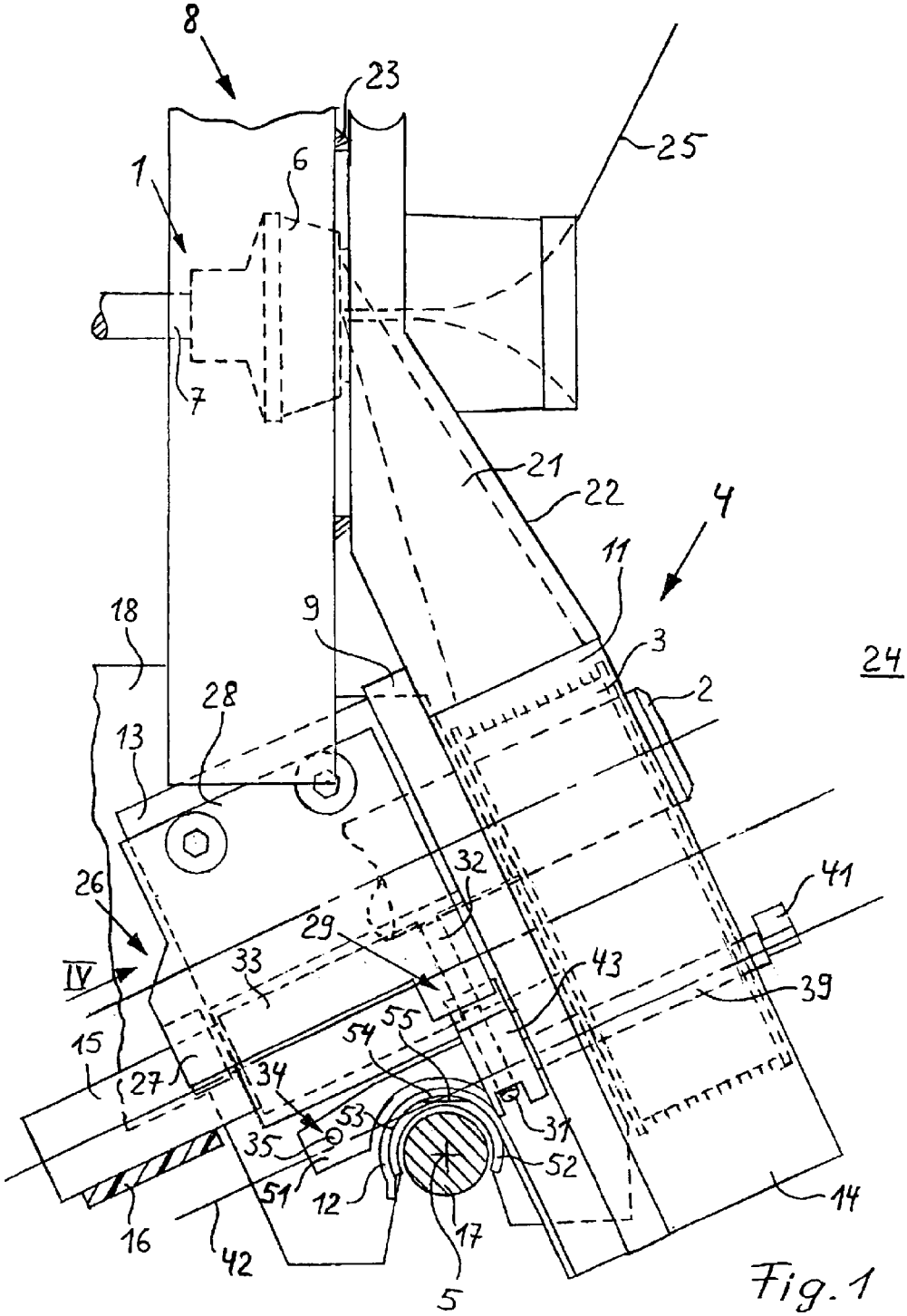
FIG. 1 is a partly sectional side view of an arrangement for open-end rotor spinning during operation, constructed according to a preferred embodiment of the invention.

The feed roller 2 and the opening roller 3, denoted only in FIG. 1, are assembled in a swivel housing 4, which can be swivelled around a stationary swivel axle 5 for maintenance purposes in a way described below and which can also be disassembled. The swivel axle 5 extends perpendicularly to the respective axles of the spinning rotor 1, the feed roller 2 and the opening roller 3.

The spinning rotor 1 comprises a rotor cup 6, and a rotor shaft 7 fixedly connected thereto. The rotor cup 6 is arranged in the known way in the inside of a rotor housing 8 in which a vacuum prevails, said rotor housing 8 being supported in a stationary way. The rotor shaft 7 penetrates through the sealed back wall of the rotor housing 8 and is supported and driven externally therefrom in a way not shown.

The swivel housing 4 comprises as an important component a plane plate 9, at which, amongst other components, an opening roller housing 11 surrounding the opening roller 3 is arranged. The plate 9 supports further a take-up 12, which serves to support, swivel and disassemble the swivel housing 4 in a way shown below. The plate 9 supports further an extension 13 for taking up the bearing of the opening roller 3 and for affixing the bearing of the feed roller 2.

The opening roller housing 11 is provided with an opening 14, through which trash particles, present in the fiber material to be spun, are expelled during the spinning operation. The trash particles fall into a trough (not shown), to which a protective metal sheet is arranged, thus preventing an operator from reaching into the opening 14.

The opening roller 3 is connected to a drive wharve 15, which is disposed against a tangential belt 16 in the operational position shown in FIG. 1. The tangential belt 16 extends between the drive wharve 15 and the swivel axle 5 in longitudinal direction of the open-end rotor spinning machine comprising a plurality of arrangements, and is pressed against the drive wharve 15 by means of a pressure roller (not shown), which also guides the returning end of the tangential belt 16.

The feed roller 2, with its bearing housing affixed to the extension 13, is connected to an electromagnetic coupling (not shown) in the known way and is driven via a worm wheel and a worm by a drive shaft 17. The axis of the drive shaft 17 extends co-axially to the swivel axle 5.

The swivel housing 4 is supported on stationary lateral walls 18 and 19 (see also FIGS. 4 to 6) of the arrangement in a way described below. The lateral walls 18 and 19 are in turn affixed to a frame (not shown) of the open-end rotor spinning machine.

In its operational state, as shown in FIG. 1, the opening roller 3 is functionally connected with the spinning rotor 1 via a fiber feed channel 21, which is located in a separate, exchangeable housing part 22 of the swivel housing 4. During operation, the housing part 22 is disposed with a seal 23 on the rotor housing 8 and seals off the inside of the rotor housing 8 to the operator's side 24. The housing part 22 supports in the known way an extension (not shown) in the area which is facing the rotor housing 8, said extension projecting into the inside of the rotor cup 6, as well as supporting other devices which serve the removal of the thread 25 spun in the spinning rotor 1.

The opening roller 3 can be brought to a standstill by means of a brake 26. The brake 26 comprises a brake block 27, which is affixed to a spring steel sheet 28, which in turn is screwed on to the extension 13.

Figure 2:
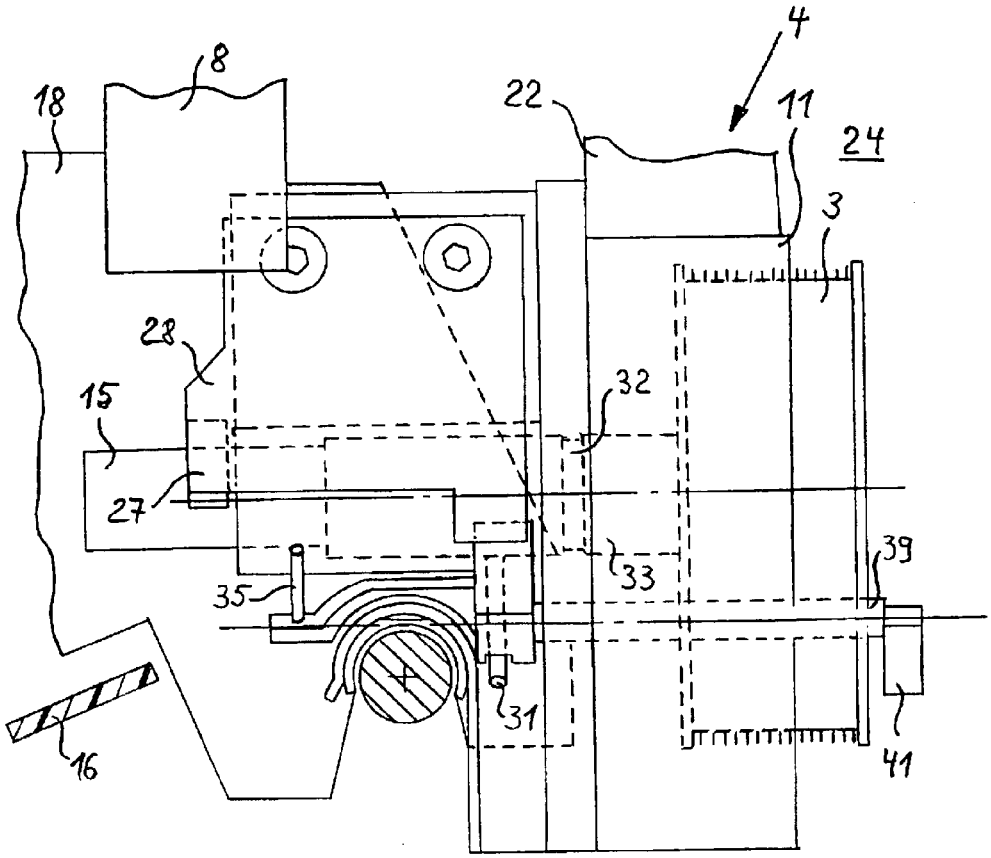
FIG. 2 is a partial view of the arrangement according to FIG. 1, in which the swivel housing is swivelled into a maintenance position.

The opening roller 3 can be removed in a simple way from the swivel housing 4, as shown in FIG. 2. The axial position of the opening roller 3 during the operational state shown in FIG. 1 is secured by an axial locking device 29. This comprises a spring bar 31, which is affixed to the swivel housing 4. During operation, the spring bar 31 is pressed into a ring groove 32, which is located on the periphery of the bearing housing 33 of the opening roller 3.

The arrangement for open-end rotor spinning is provided with a locking device 34 (see also FIG. 4), which prevents the disassembly of the swivel housing 4 while the opening roller 3 is still rotating. The locking device 34 comprises a pin-like lever 35 arranged at the swivel housing 4, and also a stopper 36, which is arranged at the lateral wall 19 of the arrangement for open-end rotor spinning. In the embodiment of the present invention, a section of a brake lever (not shown) is used as a stopper 36, which is mounted on the lateral wall 19 and with which the spinning rotor 1 can be braked. The lever 35 comprises a stopping face 37, which can be disposed on a countersurface 38 of the stopper 36. It is arranged in a movable way at the swivel housing 4 and can be swivelled into various positions.

The swivel housing 4 comprises a joint activating element 39 for the brake 26, the axial safety device 29 and the locking device 34. The activating element 39 is provided on the operator's side 24 with a handle 41. This handle 41 can be used to turn the activating element 39 around its axis 42 and bring it into various periphery positions.

The activating element 39 penetrates through the swivel housing 4 from the operator's side 24 to behind the plate 9. The activating element 39 is provided at this point with an eccentric part 43. This comprises outer eccentric surfaces 44,45,46 and inner eccentric surfaces 47,48,49 (see FIGS. 4 to 6). The outer eccentric surfaces 44,45,46 are located on the outer periphery of the eccentric part 43. The inner eccentric surfaces 47,48,49 are located in a ring groove-like recess of the eccentric part 43. The outer and inner eccentric surfaces 44,45,46,47,48,49 lie eccentric to the axis 42 of the activating element 39.

A wing 51 is adjoined to the eccentric part 43 in axial direction of the activating element 39. The pin-like lever 35 is arranged on the wing 51, which lever 35 projects from the wing 51 radially to the axis 42.

Figure 4:
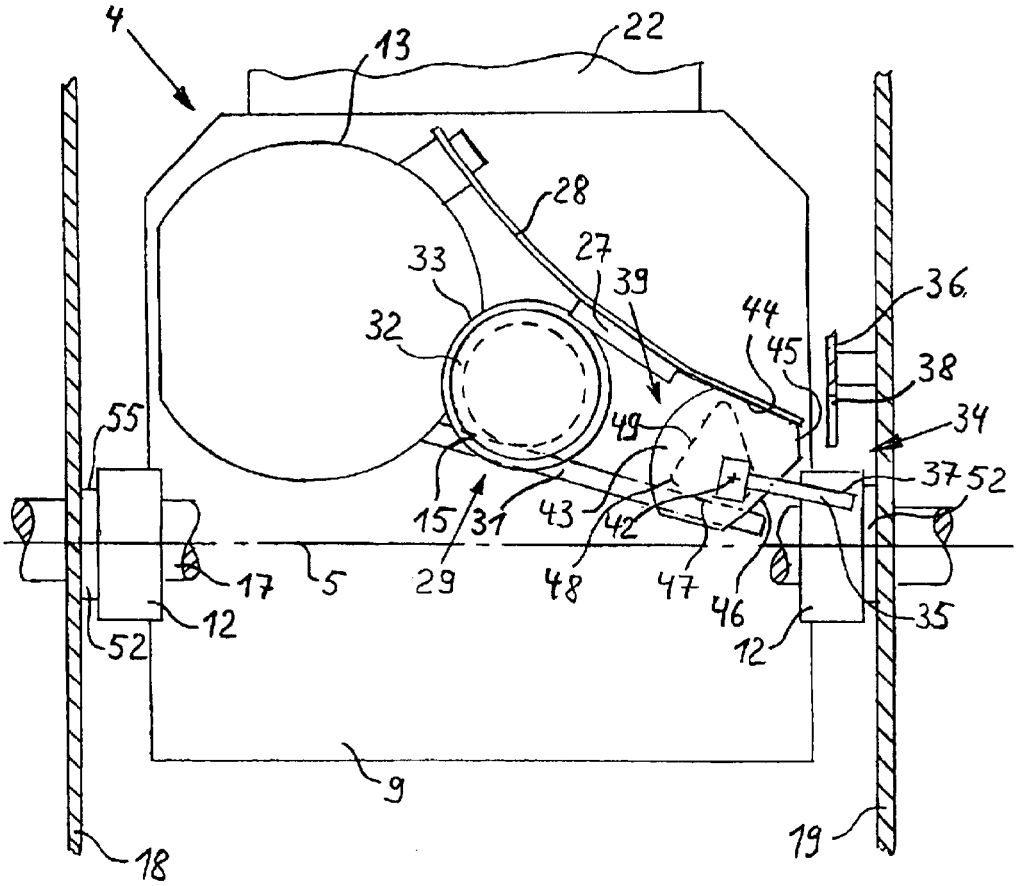
FIG. 4 is a partial view of the arrangement according to FIG. 1 in the direction of the arrow IV of FIG. 1, whereby the activating lever supporting the locking device is in a position which prevents the removal of the swivel housing.
Figure 5:
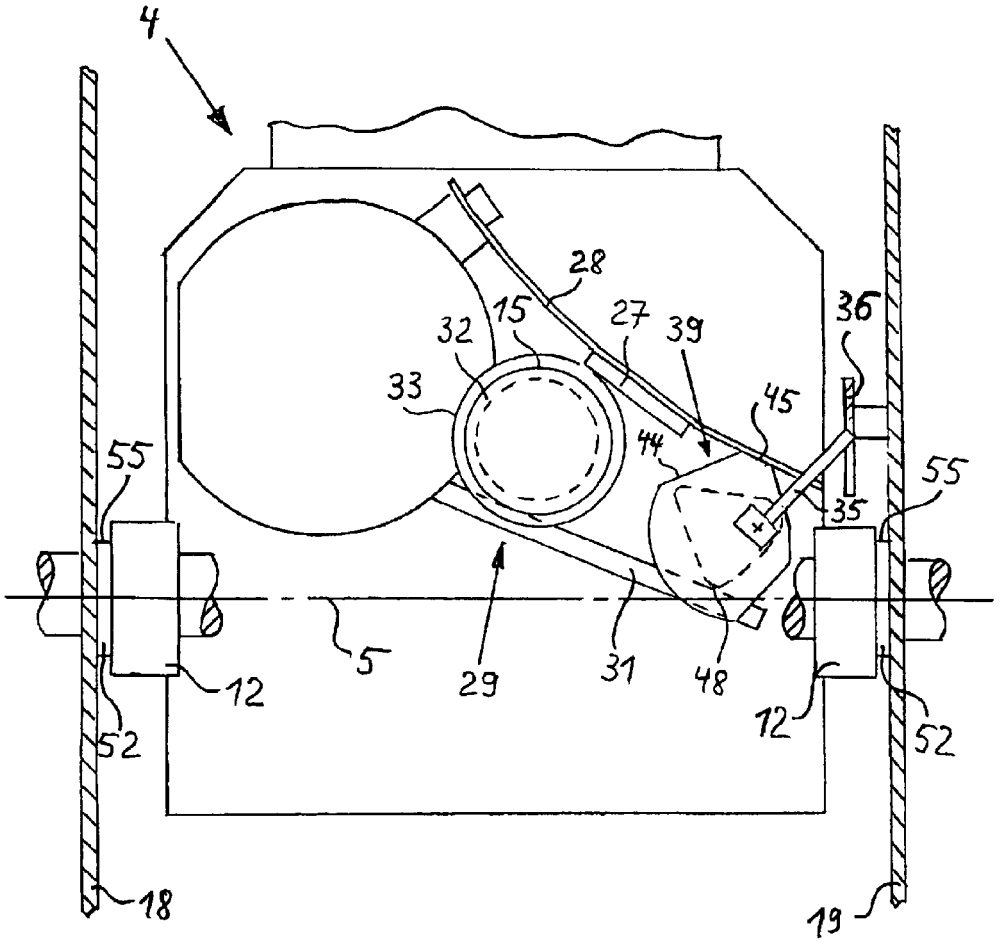
FIG. 5 is a partial view of the arrangement of FIG. 1 similar to FIG. 4, wherein the activating lever is supporting the locking device in a position which permits the removal of the opening roller.
Figure 6:
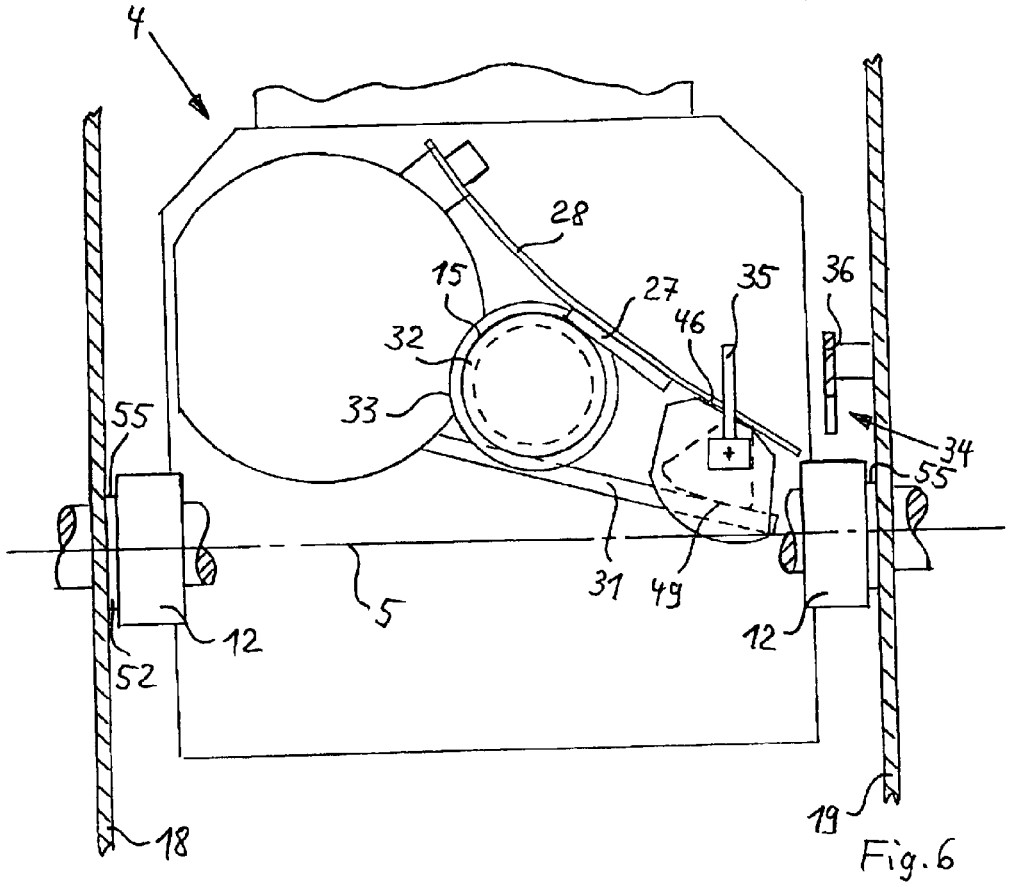
FIG. 6 is a partial view of the arrangement of FIG. 1 similar to FIG. 4, whereby the activating lever supporting the locking device is in a position which permits the removal of the swivel housing.

As can be seen in particular in FIGS. 4 to 6, the spring metal sheet 28 is disposed against the eccentric part 43 during the various rotational positions of the activating element 39. Accordingly, the spring bar 31 is disposed against the eccentric part 43 during the various turning positions of the activating element 39. The respective positions of the spring metal sheet 28 and the spring bar 31 can be determined with the aid of the eccentric part 43.

Accordingly, the respective position of the pin-shaped lever 35 can be determined by means of turning the activating element 39.

Shell-shaped holding devices 52 made of plastic are applied to the lateral walls 18 and 19 mentioned above which support the arrangement for open-end rotor spinning, which shell-shaped holding devices 52 support the swivel housing 4. The inner contour of each shell-shaped holding device 52 surrounds the drive shaft 17 with clearance, whereby the drive shaft 17 is not supported in the area of each spinning arrangement, but rather in only every fourth or sixth arrangement.

The holding devices 52 comprise a sliding surface 53 on the outside, which is principally designed as a semi-cylindrical surface, whose axis extends co-axially to the swivel axle 5. The fork-shaped take-up 12 of the swivel housing 4 mentioned above is supported in a sliding and swivelable manner on this sliding surface 53, namely with a cylindrical surface 54 provided in the base of the fork.

The semi-cylindrical surface 53 of each holding device 52 is interrupted secant-like by a plane surface 55 in such a way that the cylindrical surface 54 of the take-up 12 is not disposed on the holding device 52 in this area. This plane surface 55 serves the removal of the swivel housing 4 from its two holding devices 52.

During the operational state shown in FIG. 1, the drive wharve 15 is disposed against the tangential belt 16. The opening roller 3 is thus driven to rotate. A drive connection also exists between the rotating drive wharve 17 and the feed roller 2 during this operational state.

During the operational state shown in FIG. 1, the activating element 39 takes up the turned position shown in FIG. 4. The element 39 is thus secured against turning in a way not further described here.

As can be seen in FIG. 4, the spring metal sheet 28 is disposed against the outer eccentric surface 44. This has the effect that the brake block 27 takes up a position at a distance to the drive wharve 15. The spring metal sheet 31 is disposed against the inner eccentric surface 47. This has the effect that the spring metal sheet 31 is disposed inside the ring groove 32 of the bearing housing 33. The axial locking device 29 is effective in this position and prevents the opening roller 3 being removed axially.

Figure 3:
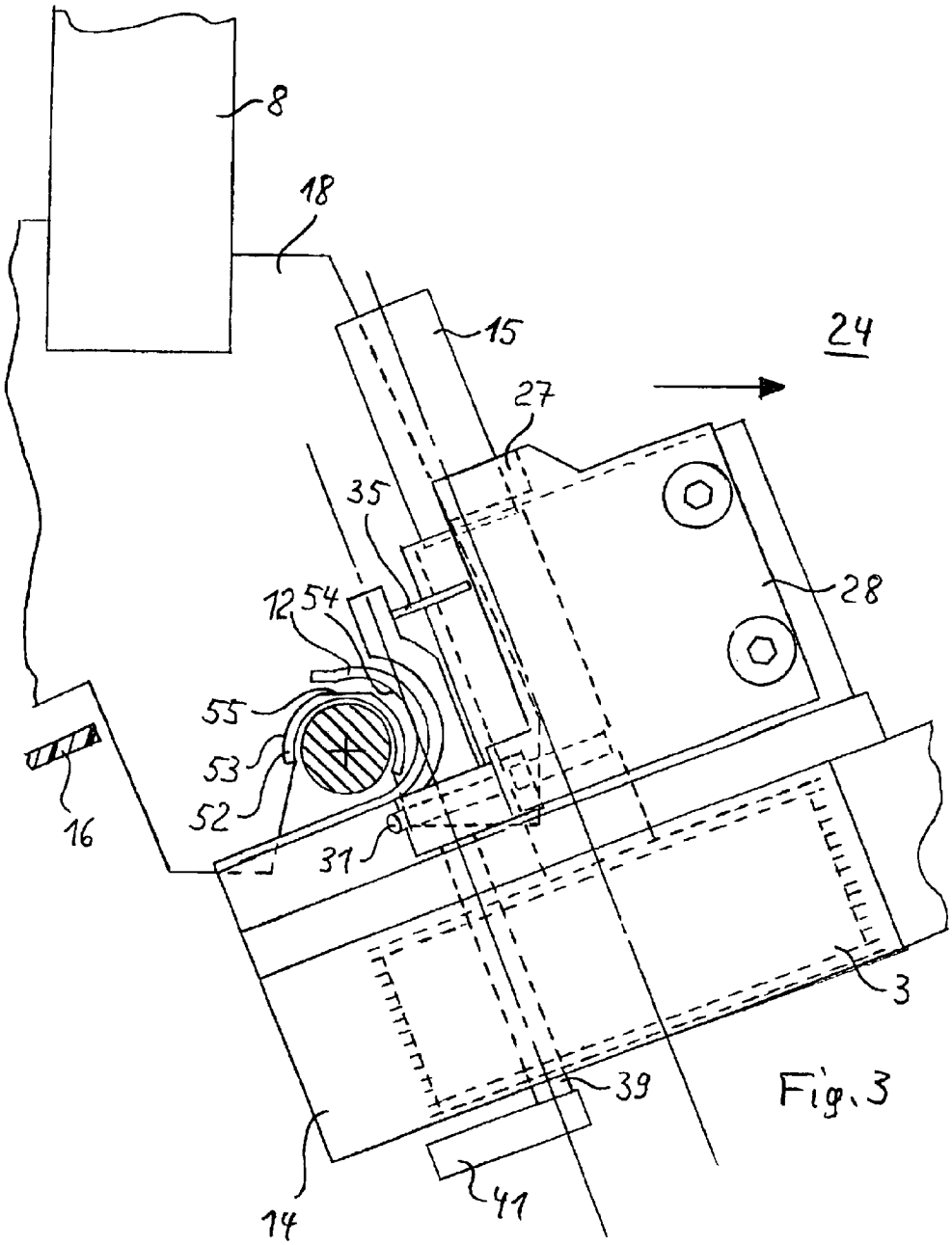
FIG. 3 is a partial view of the arrangement according to FIG. 1, in which the swivel housing is swivelled into a disassembly position.

The pin-like lever 35 is in a position in which it is disposed, as seen from the operator's side 24, behind the stopper 36. If the swivel housing 4 were to be swivelled out of its operational position as shown in FIG. 1, the drive wharve 15 would be disengaged from the tangential belt 16, while the opening roller 3 would, however, continue to rotate for quite a while due to its mass. If the swivel housing 3 were to be brought into the disassembled position as shown in FIG. 3 without turning the activating element 39, the stopping face 37 would be disposed against the countersurface 38 thus preventing the removal of the swivel housing 4. The locking device 34 thus prevents the removal of the swivel housing 4 while the opening roller 3 is still rotating.

The swivel housing 4 can be swivelled around the swivel axle 5 into the position shown in FIG. 2 for maintenance purposes. The activating element 39 hereby takes up the turned position shown in FIG. 5. The spring metal sheet 28 is disposed against the outer eccentric surface 45, so that the brake block 27 remains in a position at a distance to the drive wharve. The spring metal sheet 31 is disposed against the inner eccentric surface 48. This has the effect that the spring metal sheet 31 comes to be disposed outside of the ring groove 32 of the bearing housing 33. The axial safety device 29 is thus disengaged, permitting the opening roller 3, as shown in FIG. 2, to be removed from the operator's side 24 using a suitable gripping device to grip the opening roller 3 as soon as it has come to a standstill. Also in this turned position of the activating element 39, it would not be possible to remove the swivel housing 4 after being swivelled into the position shown in FIG. 2 towards the operator's side 24, because the lever 35 would be disposed against the stopper 36.

The swivel housing 4 can be swivelled around the swivel axle 5 into the position shown in FIG. 3 for the purpose of disassembly. The protective sheet metal mentioned above must be pushed downwards beforehand. In the swivelled position of the swivel housing 4 as shown in FIG. 3, the activating element 39 takes up the turned position shown in FIG. 6. The spring metal sheet 28 is disposed against the outer eccentric surface 46. This has the effect that the brake block 27 comes to be supported on the drive wharve 15 and brings this to a standstill within a very short time. The spring metal sheet 31 is disposed against the inner eccentric surface 49. This has the effect that the spring metal sheet 31 continues to be disposed outside of the ring groove 32 of the bearing housing 33. The lever 35 is in a position in which it no longer is disposed behind the stopper 36, as seen from the operator's side 24. When the swivel housing 4 is removed in the direction of the operator's side 24, the stopping face 37 would not be disposed on the countersurface 38. In this position, in which the opening roller 3 is braked and at a standstill, the blocking device 34, which prevents the swivel housing 4 being removed, is temporarily disengaged. The blocking device 34 is thus coupled with the brake 26 in such a way that it only releases the swivel housing 4 when the brake has been activated.

As can be seen in FIG. 3, the swivel housing 4 can be displaced slightly towards the operator's side 24 and can be removed when the tangential belt 16 is circulating, because the cylindrical surface 54 of the take-up 12 can be easily moved past the plane surface 55 of the holding device 52. The opening roller 3 is at a standstill. An operator coming into contact with the opening roller 3 by reaching into the opening 14 does not run the risk of injury.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for application in open-end rotor spinning comprising an opening roller which is driven by a tangential belt and which can be brought to a standstill by means of a brake, said opening roller being supported in a swivel housing, the swivel housing is supported by a holding device and can be removed therefrom together with the assembled opening roller while the tangential belt is still circulating, wherein a locking device is provided for preventing the removal of the swivel housing while the opening roller is still rotating.

2. An arrangement according to claim 1, wherein the locking device is coupled with the brake in such a way that it only releases the swivel housing when the brake has been activated.

3. An arrangement according to claim 1, wherein the locking device is designed as a movable lever, which can be brought into a position which prevents the swivel housing being removed.

4. An arrangement according to claim 2, wherein the locking device is designed as a movable lever, which can be brought into a position which prevents the swivel housing being removed.

5. An arrangement according to claim 3, wherein the lever is arranged at the swivel housing and comprises a stopping face, which can be disposed on a countersurface of the arrangement for open-end rotor spinning.

6. An arrangement according to claim 4, wherein the lever is arranged at the swivel housing and comprises a stopping face, which can be disposed on a countersurface of the arrangement for open-end rotor spinning.

7. An arrangement according to claim 1, wherein the locking device and the brake can be activated by means of a joint activating element.

8. An arrangement according to claim 2, wherein the locking device and the brake can be activated by means of a joint activating element.

9. An arrangement according to claim 3, wherein the locking device and the brake can be activated by means of a joint activating element.

10. An arrangement according to claim 4, wherein the locking device and the brake can be activated by means of a joint activating element.

11. An arrangement according to claim 5, wherein the locking device and the brake can be activated by means of a joint activating element.

12. An arrangement according to claim 6, wherein the locking device and the brake can be activated by means of a joint activating element.

13. An open-end rotor spinning assembly comprising:

an opening roller which in use is driven by a tangential belt extending along a plurality of adjacent spinning assemblies, a brake operable to stop rotation of the opening roller, a swivel housing surrounding and supporting the opening roller, a holding device selectively operable to hold the swivel housing at a spinning assembly frame to permit removal of the swivel housing roller from the frame while the tangential belt is moving, and a locking device operable to prevent removal of the swivel housing from the frame when the opening roller is rotating.

14. An assembly according to claim 13, wherein the locking device is coupled with the brake in such a way that it only releases the swivel housing when the brake has been activated.

15. An assembly according to claim 13, wherein the locking device is designed as a movable lever, which can be brought into a position which prevents the swivel housing being removed.

16. An assembly according to claim 14, wherein the locking device is designed as a movable lever, which can be brought into a position which prevents the swivel housing being removed.

17. An assembly according to claim 15, wherein the lever is arranged at the swivel housing and comprises a stopping face, which can be disposed on a countersurface of the arrangement for open-end rotor spinning.

18. An assembly according to claim 13, wherein the locking device and the brake can be activated by means of a joint activating element.

19. A locking device operable to prevent removal of a swivel housing from a machine frame when an opening roller is rotating in an open-end rotor spinning assembly which includes:

an opening roller which in use is driven by a tangential belt extending along a plurality of adjacent spinning assemblies, a brake operable to stop rotation of the opening roller, a swivel housing surrounding and supporting the opening roller, and a holding device selectively operable to hold the swivel housing at a spinning assembly frame to permit removal of the swivel housing roller from the frame while the tangential belt is moving.

20. An open-end rotor spinning assembly comprising:

an opening roller which in use is driven by a tangential belt extending along a plurality of adjacent spinning assemblies, a brake operable to stop rotation of the opening roller, a swivel housing surrounding and supporting the opening roller, a holding device selectively operable to hold the swivel housing at a spinning assembly frame to permit removal of the swivel housing from the frame while the tangential belt is moving, and locking means for preventing removal of the swivel housing from the spinning assembly frame when the opening roller is rotating.

* * * * *